US009888308B2

(12) United States Patent
Eichfeld

(10) Patent No.: US 9,888,308 B2
(45) Date of Patent: Feb. 6, 2018

(54) DIRECTIONAL MICROPHONE INTEGRATED INTO DEVICE CASE

(71) Applicant: Bose Corporation, Framingham, MA (US)

(72) Inventor: Jahn Dmitri Eichfeld, Natick, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/189,383

(22) Filed: Jun. 22, 2016

(65) Prior Publication Data

US 2017/0374443 A1 Dec. 28, 2017

(51) Int. Cl.

| | |
|---|---|
| ***H04R 9/08*** | (2006.01) |
| ***H04R 1/08*** | (2006.01) |
| ***H04R 1/02*** | (2006.01) |
| ***H04R 1/32*** | (2006.01) |

(52) U.S. Cl.

CPC ..... *H04R 1/086* (2013.01); *H04R 1/02* (2013.01); *H04R 1/326* (2013.01); *H04R 2499/11* (2013.01)

(58) Field of Classification Search

CPC ..... H04R 1/34; H04R 1/342; H04R 1/346; H04R 2499/11; H04R 1/326; H04B 1/3888

USPC ..... 381/358

See application file for complete search history.

(56) References Cited

U.S. PATENT DOCUMENTS

| | | | | |
|---|---|---|---|---|
| 2,739,659 A * | 3/1956 | Daniels | H04R 1/342 | 381/338 |
| 3,444,955 A * | 5/1969 | Hoffmann | H04R 1/342 | 181/158 |
| 3,657,490 A * | 4/1972 | Scheiber | H04R 1/342 | 381/338 |
| 3,836,732 A * | 9/1974 | Johanson | H04R 25/402 | 381/313 |
| 4,757,546 A * | 7/1988 | Akino | H04R 1/342 | 381/357 |
| 6,418,229 B1 * | 7/2002 | Staat | H04R 1/326 | 181/158 |
| 7,747,033 B2 * | 6/2010 | Uchimura | H04R 1/342 | 29/594 |
| 8,170,259 B2 * | 5/2012 | Liu | H04R 1/02 | 381/365 |
| 8,351,630 B2 | 1/2013 | Ickler et al. | | |

(Continued)

FOREIGN PATENT DOCUMENTS

GB 2504723 A * 2/2014 ..... H04R 1/2853

*Primary Examiner* — Curtis Kuntz
*Assistant Examiner* — Ryan Robinson

(57) ABSTRACT

A case for a portable electronic device includes an enclosed, elongated space extending within the case from an opening in an interior surface of the case. The opening corresponds to the location of a microphone in the device. The enclosed space is tapered to an increasingly smaller cross-section as it extends away from the opening. A first edge of the enclosed space aligns along most of its length with an exterior surface of the case. A screen covers a second opening in the exterior surface of the case along the first edge of the elongated space and provides an acoustic resistance between the elongated space and air outside the case through the second opening. A gasket located at the first opening couples the elongated space to the microphone of the electronic device.

12 Claims, 3 Drawing Sheets

(56) References Cited

U.S. PATENT DOCUMENTS

| | | | | |
|---|---|---|---|---|
| 8,596,412 | B1 * | 12/2013 | Jorgensen | G06F 1/1626 181/202 |
| 9,209,850 | B2 * | 12/2015 | Chang | H04B 1/3888 |
| 9,451,355 | B1 | 9/2016 | Jankovsky et al. | |
| 9,602,917 | B2 * | 3/2017 | Mulumudi | H04R 1/46 |
| 2013/0301863 | A1 * | 11/2013 | Weaver, III | H04R 1/2853 381/334 |
| 2015/0230026 | A1 | 8/2015 | Eichfeld et al. | |
| 2017/0085687 | A1 * | 3/2017 | Fernandes | H04M 1/0254 |

* cited by examiner

DIRECTIONAL MICROPHONE INTEGRATED INTO DEVICE CASE

BACKGROUND

This disclosure relates to a directional microphone integrated into a case for a device.

Hearing assistance devices generally require microphones to receive acoustic inputs (e.g. speech) in the environment of the user for reproduction by the device. In most examples, the microphones are integrated into the user's ear-worn hearing assistance device. In other examples, generally as an accessory, one or more microphones or microphone arrays are located in a portable electronic device that the user may wear on a lanyard or place on a table, or ask the person to which they are speaking to wear it themselves. These devices often have selectable microphone directivity modes, such as omnidirectional for picking up all sounds in the environment or at least all speakers around a table, and directional which uses a microphone array for selective reception of sound from a specific direction, generally intended to receive voices of target talkers while receiving less noise from others sources. Although significant signal-to-noise ratio (SNR) gains may be realized by such an accessory, particularly if the speaking person is in close proximity (e.g. willing to wear it), using such a device is more invasive to target talkers relative to user-worn microphones in a hearing assistance device. Users must carry this additional piece of electronics and ask a talker to wear the device or at least talk towards it, for example. These and other complications such as cost and stigma result in low rates of adoption.

In other examples, the microphone of a smart phone or other personal computer may be used to provide audio to a hearing assistance device paired to the smart phone, but these do not provide directional microphone processing and an associated high-SNR signal for sound sources such as a conversation partner. One proposal to improve on this, by the current inventors, was a smart phone case that included an array of eight microphones around the perimeter, as described in U.S. Patent Application Publication 2015-0230026, the entire contents of which are incorporated here by reference. Three microphones on each of the left and right side combined with single microphones at the top and bottom edge to provide directional binaural microphone signals.

In 2010, Bose Corporation of Framingham Mass. introduced a new type of loudspeaker, described in U.S. Pat. No. 8,351,630, incorporated here by reference. This speaker uses a long, tapered tube with a slot along its length covered by a resistive screen to create an extremely directional output sound field from a single acoustic driver, and was used to provide surround sound signals from a centrally-located device, such as a television or sound bar. U.S. patent application Ser. No. 14/674,072, filed Mar. 31, 2015, and titled Directional Acoustic Device, incorporated here by reference, disclosed additional shapes the directional loudspeaker could take, and disclosed that replacing the acoustic driver with a microphone converted the device into a highly-directional microphone.

SUMMARY

In general, in one aspect, a case is provided for use with a portable electronic device having a microphone coupled to space outside the electronic device through a device opening. The case includes an enclosed, elongated space extending within the case from a first case opening in an interior surface of the case. The first case opening corresponds to the location of the device opening when the electronic device is located in the case. The enclosed, elongated space is tapered to an increasingly smaller cross-section as it extends away from the first case opening. A first edge of the elongated space aligns along most of its length with an exterior surface of the case. A second case opening is in the exterior surface of the case along the first edge of the elongated space. A screen covers the second case opening along the length of the elongated space. The screen provides an acoustic resistance between the elongated space and air outside the case through the second case opening. A gasket located at the first case opening couples the elongated space to the microphone of the electronic device through the device opening.

Implementations may include one or more of the following, in any combination. The enclosed, elongated space and the screen may be a sub-assembly separate from the rest of the case. The enclosed, elongated space may be a void within the materials constituting the case. The enclosed, elongated space may extend along a back side of the case, with the screen located in the back side of the case. The enclosed, elongated space may extend along a side edge of the case. The screen may be located in the outer side edge of the case. The screen may be located in the back side of the case along the side edge. A door may open to expose the microphone to air outside the case via the device opening, bypassing the enclosed, elongated space. A mechanical switch may open and close the door. A second screen may cover the opening created when the door is be open.

The enclosed, elongated space may be a first enclosed, elongated space and may be located along a first side of the case, the case also including a second enclosed, elongated space extending within the case, the second enclosed, elongated space being tapered to an increasingly smaller cross-section as it extends away from a first end of the second enclosed, elongated space, the total length of the second elongated space being the same as the total length of the first elongated space, the second enclosed, elongated space being on a second side of the case opposite the first side of the case, and a first edge of the second elongated space aligning along most of its length with the second exterior surface of the case, a fourth case opening in the second exterior surface of the case along the first edge of the second elongated space, and a second screen covering the fourth case opening along the length of the second elongated space, the second screen providing an acoustic resistance between the second elongated space and air outside the case through the fourth case opening. The first end of the second enclosed, elongated space may include a third case opening in the interior surface of the case, the third case opening corresponding to a location of a second device opening associated with a second microphone when the electronic device is located in the case, the case further including a second gasket located at the third case opening for coupling the second elongated space to the second microphone of the electronic device through the second device opening. The first end of the second, elongated space may be the first case opening, such that both the first and the second enclosed, elongated spaces provide sound to the microphone through the device opening.

In general, in one aspect, a case for use with a portable electronic device includes a microphone, an enclosed, elongated space extending within the case from the microphone and acoustically coupled to the microphone, the enclosed, elongated space being tapered to an increasingly smaller cross-section as it extends away from the microphone, and a first edge of the elongated space aligning along most of its length with an exterior surface of the case, an opening in the exterior surface of the case along the first edge of the elongated space, and a screen covering the opening along the length of the elongated space, the screen providing an acoustic resistance between the elongated space and air outside the case through the opening.

Implementations may include one or more of the following, in any combination. A connector may electrically couple an output signal of the microphone to an input of the electronic device. A wireless interface may communicate an output signal of the microphone.

In general, in one aspect, a microphone enclosure includes an enclosed, elongated tube extending from a first opening, the enclosed, elongated space being tapered to an increasingly smaller cross-section as it extends away from the first opening. A second opening is located in an exterior surface of the tube. A screen covers the second opening along the length of the elongated space, the screen providing an acoustic resistance between the elongated space and air outside the tube through the second opening. A gasket located at the first opening couples the elongated space to a microphone.

Advantages include providing improved signal-to-noise ratio due to the highly-directional microphone without requiring the user to transport extra devices, and without added cost and complexity compared to external or multi-microphone devices.

All examples and features mentioned above can be combined in any technically possible way. Other features and advantages will be apparent from the description and the claims.

DESCRIPTION

Figures 1, 2, 3:
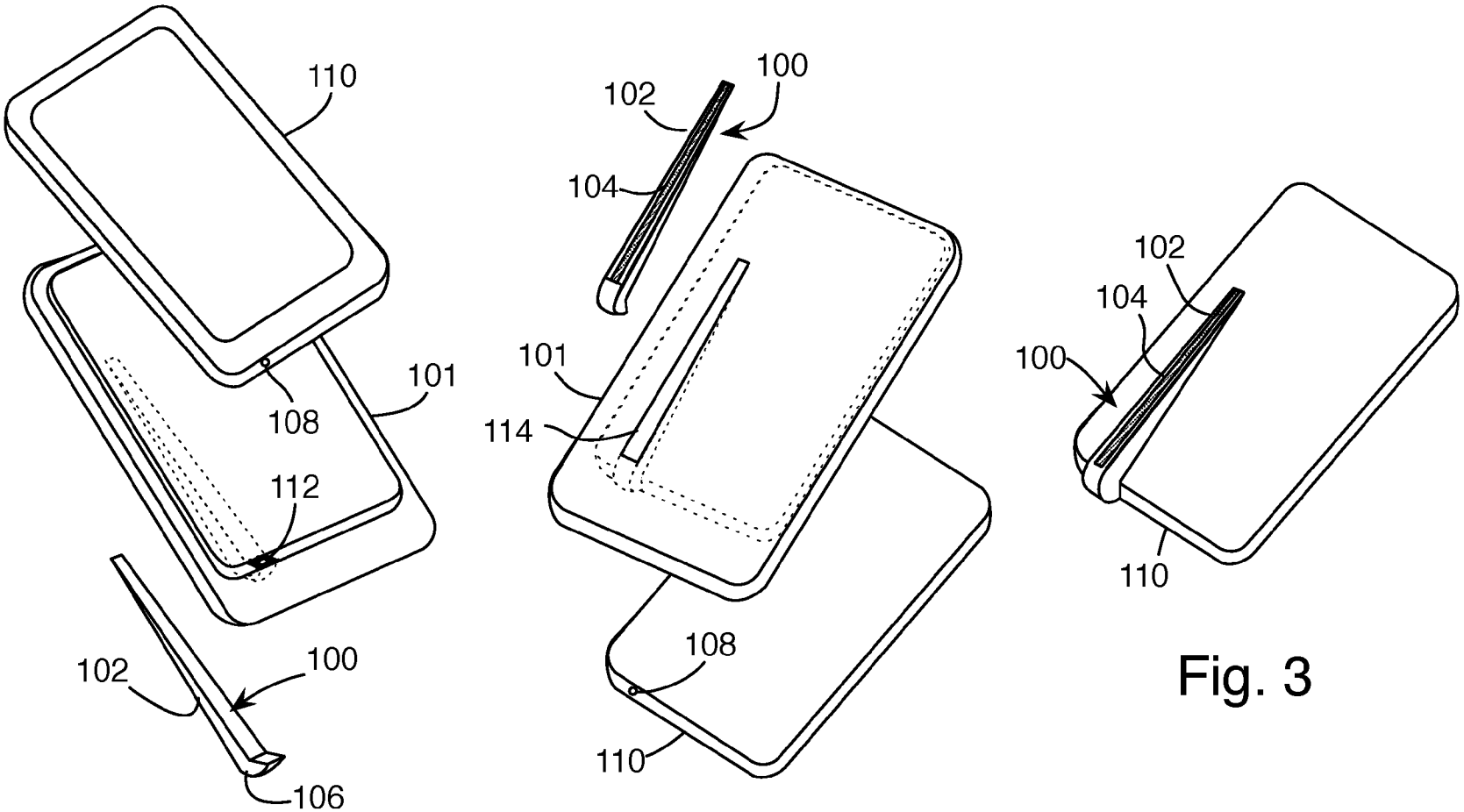
FIGS. 1 and 2 show an exploded view of an electronic device, a case for the device, and a microphone enclosure for use with the device.
FIG. 3 shows the microphone enclosure and electronic device of FIGS. 1 and 2 without the case.

A highly-directional microphone module may be provided without significant added cost or complexity by adapting the directional loudspeaker enclosure of U.S. Pat. No. 8,351,630 for use with a smart phone's built-in microphone, by incorporating it into a case for the smart phone, as shown in FIGS. 1, 2, and 3. FIGS. 1 and 2 show an exploded view with the phone and the microphone enclosure both removed from the case, while FIG. 3 shows the microphone enclosure assembled to the phone with the case hidden for clarity. In some examples, the closure is not actually a separate part from the case, but is simply an empty space within the material of the case.

The enclosure 100 includes an elongated tube 102 that is located or embedded in the back of the phone case 101, with a resistive screen 104 along its length exposed on the back of the case. The tube turns (106) at the bottom to enclose the opening 108 for the built-in voice microphone of the smart phone 110. A gasket 112 seals the tube to the microphone opening. The tube is tapered within the case, with an increasingly smaller cross-section along its length extending away from the microphone. If the enclosure 100 is a separate part from the case 101, it is exposed through an opening 114 in the back of the case 101. Placed on a table in front of the user, the slot can be aimed at another person or any other localized sound source. This configuration provides a similar effect to the separate microphone array modules found in the market today, but without the added complexity of carrying and deploying an additional device, and without the social stigma of having to use such a device (assuming it is socially acceptable to place one's phone on the table during a conversation). Moreover, because the enclosure is acoustically passive, relying on the phone's existing microphone, existing connection to the hearing assistance device (typically a wireless between the microphone array and the hearing assistance device in other products), and processing capabilities, it can be extremely inexpensive to manufacture.

Figure 5:
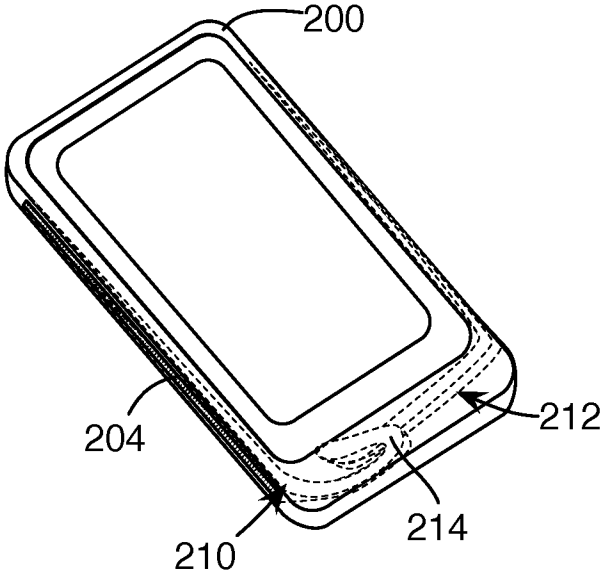
FIGS. 4 and 5 show alternative embodiments of the case and microphone enclosure, including an optional second microphone enclosure.
Figure 4:
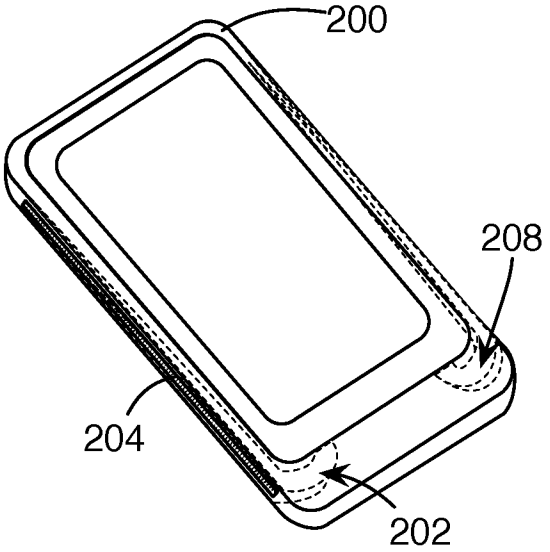

Another example is shown in FIG. 4, fully assembled, with the enclosure 202 along the side of the case 200, with the screen 204 on the edge 206. This may provide for a thinner profile, at the expense of making the case slightly wider. If the phone has a pair of microphones at the bottom, an enclosure may be provided on each side (optional enclosure 208), enhancing a binaural or stereo microphone effect provided by the pair of microphones. In another example, shown in FIG. 5, the two enclosures 210, 212 are coupled to a single microphone, providing even greater directivity, similarly to the array of microphones proposed in the 2015-0230026 application. That is, sound arriving from the side is detected and routed to the microphone first by the near-side enclosure, and then by the far-side enclosure. For some frequencies, the delay causes the two signals to cancel. Sound arriving on-axis is detected at the same time on both sides, increasing the signal-to-noise ratio. If, as shown, the microphone is not centered, the enclosure on the side closer to the microphone may include some additional serpentine curves 214 to match its total length to the distance of the far enclosure from the microphone.

Figure 6:
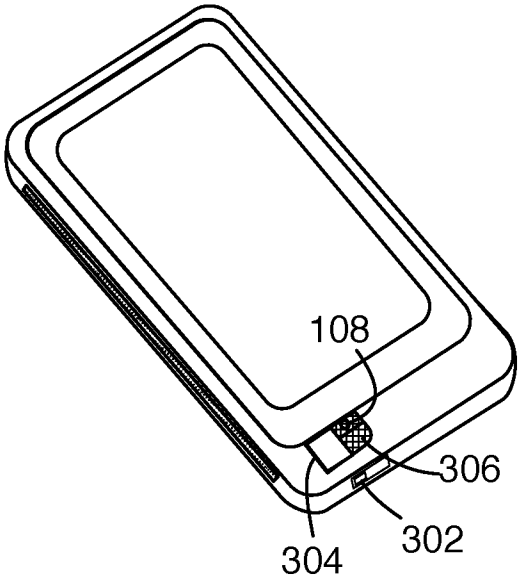
FIG. 6 shows an alternative embodiment of the case and microphone enclosure, including a door.

In another example, shown in FIG. 6, a mechanical switch 302 opens a door 304 exposing the smartphone's microphone opening 108 so that it can directly pick up the user's voice when used in a conventional fashion as a phone handset. An optional grille 306 protects the microphone opening. In some examples, the switch 302 is not provided, and the user may simply move the door 304 directly. This feature may not be necessary, depending on the quality of the near-field signal pickup when the case from the previous examples is used without directly exposing the microphone opening 108.

Figure 7:
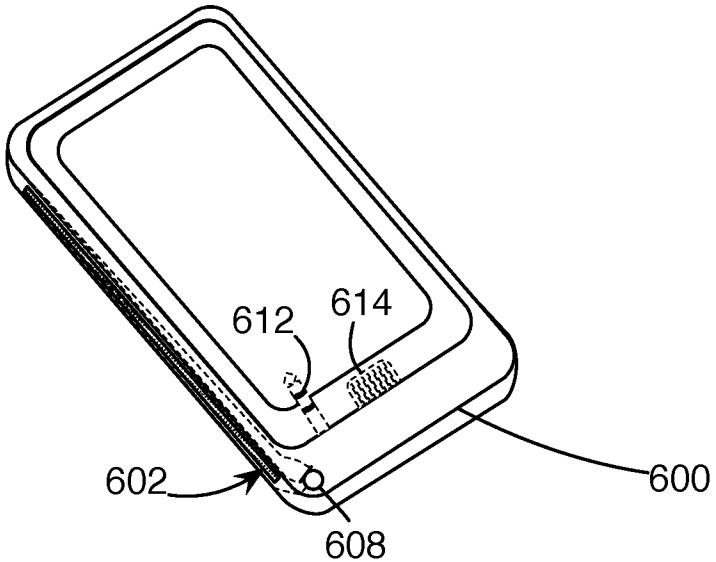
FIG. 7 shows an alternative embodiment of the case and microphone enclosure, including a microphone in the case.

In another example, shown in FIG. 7, a microphone 608 is provided as part of the case 600, coupled to the enclosure 602. This may eliminate the bend 106 from the example of FIG. 1, allowing other freedoms in case design, and improving on the signal quality over the microphone built into the smart phone. A microphone could also be provided in the example of FIGS. 1-3, with the enclosure on the back of the case. The microphone 608 may be electrically connected to the smartphone through a headphone plug 612 or a data connector 612, similarly to how external battery cases connect to smartphone charging ports. This would allow the case to continue to take advantage of the phone for wireless and processing capabilities, preserving some of the cost and complexity advantages of the earlier examples while providing even higher voice pickup quality. Alternatively, if the hearing assistance device uses a wireless technology not supported by the phone, the case may include a compatible transceiver and not only connect the microphone to the hearing assistance device, but also connect the phone to the hearing assistance device. Providing microphones with the case can also allow the two-sided binaural or stereo case from FIG. 4 to be used with phones that otherwise have only one microphone.

A number of implementations have been described. Nevertheless, it will be understood that additional modifications may be made without departing from the scope of the inventive concepts described herein, and, accordingly, other embodiments are within the scope of the following claims.

What is claimed is:

1. A case for use with a portable electronic device having a microphone coupled to space outside the electronic device through a device opening, the case comprising:

a first enclosed, elongated space extending within the case from a first case opening in an interior surface of the case along a first side of the case, the first case opening corresponding to the location of the device opening when the electronic device is located in the case, the first enclosed, elongated space being tapered to an increasingly smaller cross-section as it extends away from the first case opening, and a first edge of the first elongated space aligning along most of its length with an exterior surface of the case;

a second case opening in the exterior surface of the case along the first edge of the first elongated space;

a screen covering the second case opening along the length of the first elongated space, the screen providing an acoustic resistance between the first elongated space and air outside the case through the second case opening;

a gasket located at the first case opening for coupling the first elongated space to the microphone of the electronic device through the device opening;

a second enclosed, elongated space extending within the case, the second enclosed, elongated space being tapered to an increasingly smaller cross-section as it extends away from a first end of the second enclosed, elongated space, the total length of the second elongated space being the same as the total length of the first elongated space, the second enclosed, elongated space being on a second side of the case opposite the first side of the case, and a first edge of the second elongated space aligning along most of its length with the second exterior surface of the case;

a fourth case opening in the second exterior surface of the case along the first edge of the second elongated space; and a second screen covering the fourth case opening along the length of the second elongated space, the second screen providing an acoustic resistance between the second elongated space and air outside the case through the fourth case opening.

2. The case of claim 1, wherein the first and second enclosed, elongated spaces and the screens are sub-assemblies separate from the rest of the case.

3. The case of claim 1, wherein the first and second enclosed, elongated spaces comprise voids within the materials constituting the case.

4. The case of claim 1, wherein the first and second enclosed, elongated spaces extend along a back side of the case, and the screens are located in the back side of the case.

5. The case of claim 1, wherein the first and second enclosed, elongated spaces extends along first and second side edges of the case.

6. The case of claim 5, wherein the screens are located in the outer side edges of the case.

7. The case of claim 5, wherein the screens are located in the back side of the case along the side edges.

8. The case of claim 1, further comprising a door that opens to expose the microphone to air outside the case via the device opening, bypassing the first and second enclosed, elongated spaces.

9. The case of claim 8, further comprising a mechanical switch that opens and closes the door.

10. The case of claim 8, further comprising a second screen covering the opening created when the door is open.

11. The case of claim 1, wherein:

the first end of the second enclosed, elongated space comprises a third case opening in the interior surface of the case, the third case opening corresponding to a location of a second device opening associated with a second microphone when the electronic device is located in the case, and the case further comprises:

a second gasket located at the third case opening for coupling the second elongated space to the second microphone of the electronic device through the second device opening.

12. The case of claim 1, wherein:

the first end of the second, elongated space comprises the first case opening, such that both the first and the second enclosed, elongated spaces provide sound to the microphone through the device opening.

* * * * *